US009719250B2

(12) United States Patent
Perrier et al.

(10) Patent No.: US 9,719,250 B2
(45) Date of Patent: Aug. 1, 2017

(54) METHOD AND A SYSTEM FOR FASTENING AN OBJECT TO A FACADE

(75) Inventors: Matthieu Perrier, Valence (FR); Alain Gauthier, Sain Jean de Muzols (FR)

(73) Assignee: SOCIETE DE PROSPECTION ET D'INVENTIONS TECHNIQUES—SPIT, Bourg-les-Valence (FR)

( * ) Notice: Subject to any disclaimer, the term of this patent is extended or adjusted under 35 U.S.C. 154(b) by 31 days.

(21) Appl. No.: 14/233,995

(22) PCT Filed: Jul. 20, 2012

(86) PCT No.: PCT/IB2012/053729

§ 371 (c)(1),
(2), (4) Date: Jan. 21, 2014

(87) PCT Pub. No.: WO2013/011497

PCT Pub. Date: Jan. 24, 2013

(65) Prior Publication Data

US 2014/0144094 A1 May 29, 2014

(30) Foreign Application Priority Data

Jul. 21, 2011 (FR) ..... 11 56619

(51) Int. Cl.

| | |
|---|---|
| ***E04B 1/16*** | (2006.01) |
| ***E04B 2/56*** | (2006.01) |
| ***E04B 1/76*** | (2006.01) |

(52) U.S. Cl.

CPC ..... *E04B 2/56* (2013.01); *E04B 1/76* (2013.01); *E04B 1/7637* (2013.01)

(58) Field of Classification Search

CPC . E04C 2/04; E04C 2/049; E04C 2/284; E04C 2/288

(Continued)

(56) References Cited

U.S. PATENT DOCUMENTS 1,631,787 A * 6/1927 Bennett ..... 52/354
5,277,864 A * 1/1994 Blatz ..... 264/328.17

(Continued)

FOREIGN PATENT DOCUMENTS

DE 20107906 U1 9/2001
DE 202006007078 U1 9/2006

(Continued)

OTHER PUBLICATIONS

English Translation of DE20 22009 013 846 (cited also as EP2309068). Feb. 4, 2010.*

*Primary Examiner* — William Gilbert
(74) *Attorney, Agent, or Firm* — Hauptman Ham, LLP

(57) ABSTRACT

A method and a system for fastening an object to a façade comprising at least one supporting wall made in a hard material coated externally with a thermal insulation coat made in a crumbly material, the object being fastened to the wall by means of a fastening member received in an area for receiving a plot made in a hard material arranged in projection out of the wall. The object is fastened to the wall in an indirect way offsetting towards the outside of the façade the area of the plot. The plot is fastened to the wall by a fastening area extending between the wall and the receiving area. The plot is a straight cylinder extending through the insulation coat.

5 Claims, 2 Drawing Sheets

(58) Field of Classification Search
USPC ... 52/354, 355, 309.8, 368, 369, 376, 483.1, 52/745.05
See application file for complete search history.

(56) References Cited

U.S. PATENT DOCUMENTS

| | | | | |
|---|---|---|---|---|
| 5,406,756 | A * | 4/1995 | Bemis et al. | 52/16 |
| 7,556,849 | B2 * | 7/2009 | Thompson | B32B 11/06 428/167 |
| 8,256,185 | B2 * | 9/2012 | Kirkey | E04D 1/20 52/518 |

FOREIGN PATENT DOCUMENTS

| | | | |
|---|---|---|---|
| DE | 202009013846 | U1 | 3/2010 |
| EP | 0922568 | A1 | 6/1999 |
| EP | 2161385 | A1 | 3/2010 |

* cited by examiner

METHOD AND A SYSTEM FOR FASTENING AN OBJECT TO A FACADE

RELATED APPLICATIONS

The present application is a U.S. national phase entry of International Application Number PCT/IB2012/053729 filed Jul. 20, 2012, which claims priority to French Application Number 1156619 filed Jul. 21, 2011.

The field of this invention relates to fastening objects to externally thermally insulated building façades. This relates to fastening, for instance, manropes, blind bars, shutters, rainwater pipes, supporting ramps and other domotic equipment, such as letter boxes.

An externally insulated façade (FIG. 1) generally comprises, from the inside to the outside, a hard supporting wall 1, either solid or hollow, to be insulated, a first coating layer 2, an insulation coat 3 and at least one second external top coating layer 4.

The insulation coat 3 is made in a crumbly material, often polystyrene. A polystyrene panel is fastened to the wall, on the one hand, through gluing and, on the other hand, by means of fastening dowels 5. Between the insulation coat 3 and the external coating 4, there could still be arranged a first flattening layer 6, a layer of glass fibers 7 and a second flattening layer 8.

Fastening objects to such façades generally occurs through drilling holes up to the wall for anchoring therein threaded fastening end stems projecting out of the external top coating. As these are generally stems made in steel, being relatively well conductive, thermal bridges are thereby generated, being detrimental to the quality of the insulation. This is this problem that the invention of the present application tries to overcome.

A method is already known for fastening an object to a façade comprising at least a supporting wall made in a hard material, being coated, externally, with a crumbly material thermal insulation coat, the object being fastened to the wall by means of a fastening member received in a hard material receiving area, in which method the object is fastened to the wall in an indirect way, offsetting towards the exterior of the façade the fastening member receiving area of the object. Such a method is provided by the Dosteba company.

The fastening member whereby the object is fastened is no longer directly received in the wall, but indirectly, in an offset area, also made in a hard material, not necessarily the same as that of the wall. Thereby, having to drill the insulating coating could be omitted, thereby preventing a thermal bridge from being generated.

But, according to this method, not only the receiving area of the object fastening member is offset towards the exterior of the façade, but this hard material receiving area becomes laterally offset along the supporting wall with respect to a fastening area to the wall of the receiving area. There results therefrom a drawback.

Because of the hard material fastening and receiving areas being offset, thereby forming a shoulder, the insulation coat should be able to be adapted to such an offset being cut so as to arrange a shoulder defined by two perpendicular cutting planes. This is very difficult, or even impossible or unworkable. Actually, the insulation coat is cut according to one single cutting plane and the shoulder is plugged with an additional piece of the coating. This is tedious and expensive.

The invention of the present application aims at solving such a drawback.

Thus, the invention of the present application relates to a method of the above defined type, characterized in that the receiving area of the object fastening member is fastened to the wall via a fastening area extending between the wall and the receiving area.

Thus, the hard material fastening and receiving areas being in the continuation one to the other, they could have a reduced section, as well as the receiving well of these areas provided in the insulation coat, resulting in being advantageously able to reduce the reinforcing members to be arranged on the insulation coat.

Preferably, for the receiving area of the fastening member being offset towards the exterior of the façade, an intermediary supporting part is arranged on the wall, to be fastened to the wall and to which the object is fastened.

Advantageously, first the intermediary supporting part is fastened to the wall, before the insulation coat is applied against the wall and around the intermediary part, that can be afterwards cut so as to be flush with the insulation coat.

This invention also relates to a system for fastening an object to a façade comprising at least one hard material supporting wall externally coated with a crumbly material thermal insulation coat, the object being fastened to the wall by means of a fastening member received in a hard material plot receiving area arranged in projection out of the wall, characterized in that the plot is a straight cylinder extending through the insulation coat and fastened to the wall through a fastening area extending between the wall and the receiving area.

Otherwise stated, the plot is an intermediary supporting part being fastened to the wall and to which the object is fastened and having the shape of a small I-shaped girder.

Preferably, the fastening plot arranged on the wall is flush with the external side of the insulation coat.

The plot of the system of the invention, arranged for being able to be cut and be flush with the external side of any insulation coat, therefore has some all purpose character.

Advantageously, the fastening area to the wall of the receiving plot of the object fastening member comprises clearances for receiving means for fastening the plot to the wall.

In the preferred embodiment of the system of this invention, the fastening plot is made in a composite plastic material loaded with expanded clay beads.

As a composite plastic material, preferably polyurethane will be selected.

Preferably, the fastening system is arranged for fastening a plurality of objects and there is arranged on the wall a plurality of plots for receiving a fastening member.

This invention will be better understood from the following description of the fastening system of this invention, with reference to the appended drawing wherein.

Figure 3:
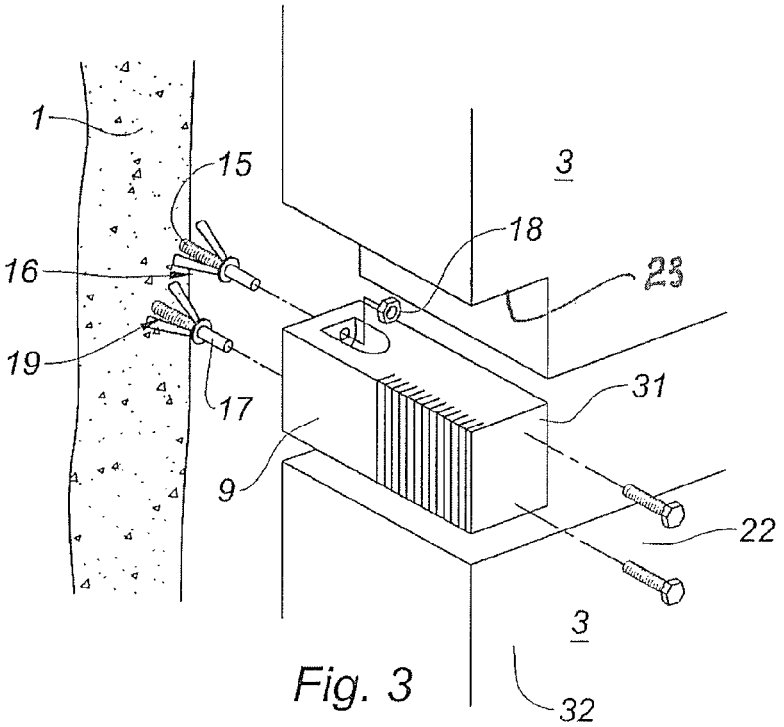
FIG. 3 is an exploded view of the fastening system.

With reference to FIG. 3, the façade is schematically shown to which an object is to be fastened, being limited to a hard material supporting wall 1 and a crumbly material thermal insulation coating 3.

The fastening system comprises an intermediary supporting plot 9, made in a hard material, fastened to the wall 1 and to which the object to be fastened to the wall 1 will be fastened.

Figure 1:
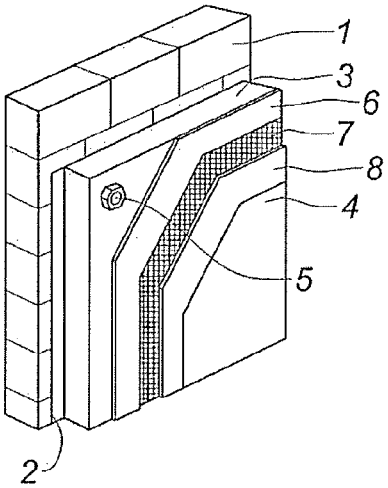
FIG. 1 is an exploded view of a thermally insulated building façade.
Figure 2:
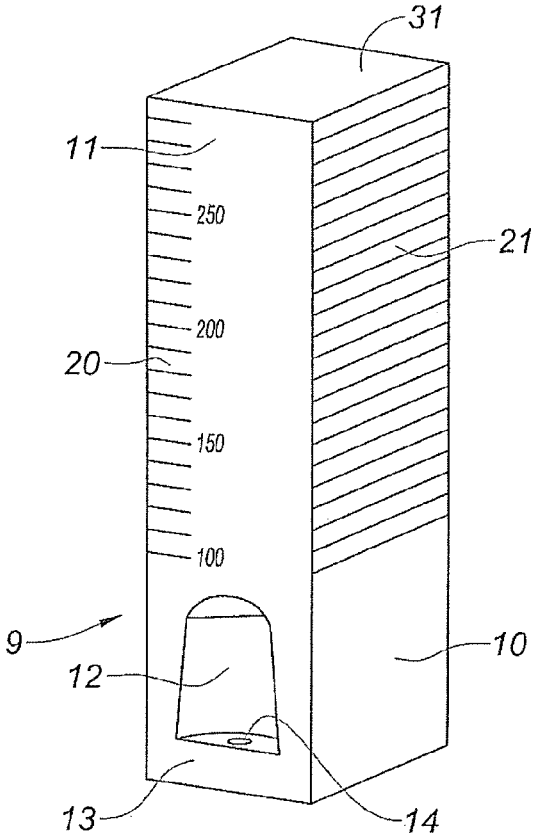
FIG. 2 is a perspective view of an intermediary supporting plot of the fastening system of this invention.

With reference to FIG. 2, the intermediary fastening plot has the shape of a small I-shaped girder, more particularly a two area parallelepiped, with one area 10 for fastening to the wall and one area 11 for receiving at least one member for fastening and adapting to the thickness of the insulation coat 3. The plot 9 is a straight cylinder.

The fastening area 10 comprises, herein the one opposite the other, two small fastening clearances or cavities 12 for receiving each a member for fastening the plot to the wall. In the present case, the base 13 of a cavity 12 is drilled with a through-hole 14 through which a threaded pin 19 fastened to an end 15 by means of an anchoring dowel 16 in the wall 1 can pass and having its other end 17, when the plot 9 is firmly stuck against the wall 1, projecting in the cavity 12 so as to receive a fastening bolt 18 and thus fasten the plot 9 to the wall 1.

The receiving area 11 of a fastening member is also an area for adapting the length of the intermediary plot 9 so as to adapt it to the thickness of the insulation coat 3. Such an area 11 comprises, on the one hand, a length measuring ruler 20 and, on the other hand, precut grooves 21.

The fastening members 22 for the object to be fastened in the intermediary plot 9 are engaged through the end side 31 of the area 11.

The plot 9 is here and preferably made in polyurethane loaded with expanded clay beads.

The object fastening system having been described, the fastening method will be now explained.

Instead of fastening the object directly to the wall 1, it is fastened thereon in an indirect way arranging on the wall the intermediary plot 9 and fastening it through its fastening area 10, extending between the wall and its receiving area 11, by means of dowels 16, before fastening the object to the plot 9 by means, here, of screws 22.

The receiving area of the screws 22 has thereby been offset to the exterior of the façade.

The insulating coating 3 is subsequently laid down. To this end, the insulating panel(s) is/are cut up so as to release a cavity 23 corresponding to the section of the plot 9—it is shown on FIG. 3 as a shoulder—and the panel(s) is/are laid down against the wall 1 (or against a first coating layer) around the plot 9. The plot 9 projecting out of the external side of the coating 3, its length is adapted and the plot 9 is cut through a precut groove 21 so that, finally, the end side 31 of the plot 9 that should receive the screws 22 is flush with the external side 32 of the insulation coat 3. Thus, the plot 9 can be referred to as being multi-purpose.

Of course, there will be fastened to the wall 1 as many intermediary plots as necessary for fastening all the objects thereto.

Figure 4:
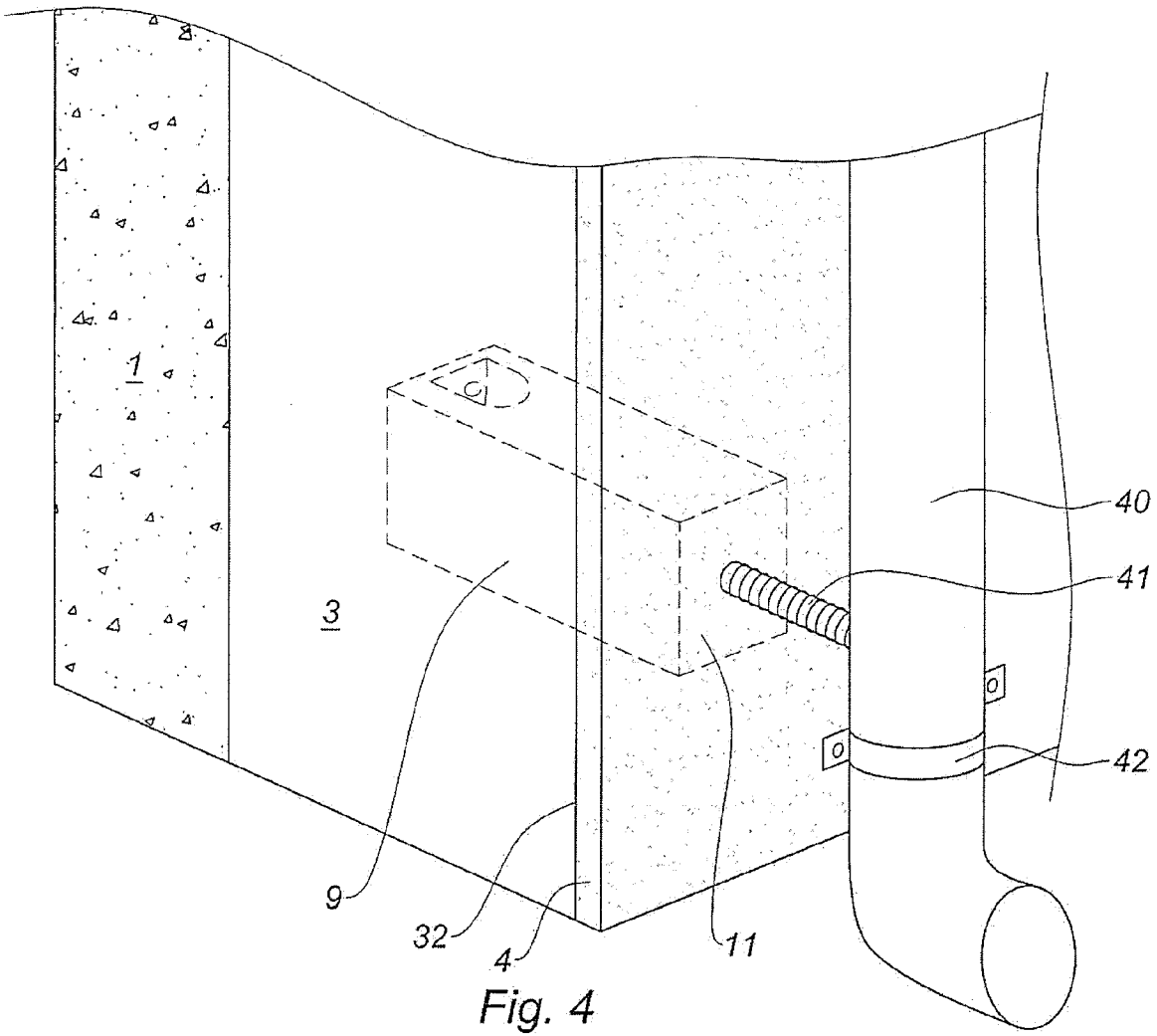
FIG. 4 is a view illustrating the application of the system of the invention to fastening a rainwater pipe.

With reference to FIG. 4, a rainwater pipe 40 is fastened to a façade, here comprising a wall 1, an insulating coating 3 and an external coating layer 4, by means of a plot 9, fastened to the wall 1 and embedded in the insulating coating 3. The pipe 40 is fastened to the wall 1 by a clamp 42 fastened to the plot 9, in its receiving area 11, via a pin 41. It should be noticed that the plot 9 is flush with the external side 32—in fact that of the external coating layer 4, nearly merged into that—of the coating 3.

The invention claimed is:

1. A method for fastening an object to a façade comprising at least one supporting wall made of a hard material being coated externally with a thermal insulation coat made of a crumbly material, the method comprising fastening the object to the wall by means of a fastening member received in a receiving area, and first fastening an intermediary supporting part to the wall before the insulation coat is laid down against the wall and around the intermediary part, the intermediary supporting part being configured to be subsequently cut so that it is flush with the insulation coat, the method further comprising subsequently cutting the intermediary supporting part so that it is flush with the insulation coat, wherein the object is fastened to the wall in an indirect way offsetting to the outside of the façade the receiving area, and the receiving area is fastened to the wall via a fastening area extending between the wall and the receiving area.

2. The method according to claim 1 further comprising arranging the intermediary supporting part on the wall that is fastened to the wall and to which the object is fastened such that the receiving area of the fastening member is offset towards the outside of the façade.

3. The method according to claim 1, wherein the action of cutting the intermediary supporting part is accomplished based at least in part on at least one of a length measuring ruler or precut grooves that are integral with the intermediary supporting part.

4. The method according to claim 1, wherein the action of cutting the intermediary supporting part is accomplished based at least in part on a length measuring ruler and precut grooves that are integral with the intermediary supporting part.

5. The method according to claim 1, wherein the fastening area further includes a cavity for receiving a nut and/or bolt for fastening the plot to the wall.

* * * * *